US008317550B2

(12) United States Patent
Cao et al.

(10) Patent No.: US 8,317,550 B2
(45) Date of Patent: Nov. 27, 2012

(54) ELECTRICAL RECEPTACLE TERMINAL

(75) Inventors: Qing-Shan Cao, Shenzhen (CN); Fu-Qiu Shi, Shenzhen (CN); Sheng-Peng Tseng, Tu-Cheng (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 104 days.

(21) Appl. No.: 13/091,139

(22) Filed: Apr. 21, 2011

(65) Prior Publication Data

US 2012/0071036 A1 Mar. 22, 2012

(30) Foreign Application Priority Data

Sep. 21, 2010 (CN) ..... 2010 1 0289212

(51) Int. Cl.
*H01R 4/48* (2006.01)

(52) U.S. Cl. ..... 439/816; 439/857

(58) Field of Classification Search ..... 439/816, 439/817, 822, 834–835, 856–857
See application file for complete search history.

(56) References Cited

U.S. PATENT DOCUMENTS

| | | | | |
|---|---|---|---|---|
| 7,674,140 | B2 * | 3/2010 | Eppe et al. | 439/816 |
| 7,740,511 | B2 * | 6/2010 | Katano | 439/816 |
| 7,927,158 | B2 * | 4/2011 | Kim et al. | 439/816 |
| 8,040,678 | B2 * | 10/2011 | Tai et al. | 361/752 |
| 8,137,144 | B1 * | 3/2012 | Wang | 439/844 |

FOREIGN PATENT DOCUMENTS

JP 7176339 A 7/1995

* cited by examiner

*Primary Examiner* — Khiem Nguyen
(74) *Attorney, Agent, or Firm* — Altis Law Group, Inc.

(57) ABSTRACT

A receptacle terminal to be utilized in an electrical receptacle includes a first sidewall, a second sidewall, a connecting member, and a restricting member. The second sidewall cooperates with the first sidewall to define a receiving space to receive an electrical terminal. The connecting member connects the first sidewall to the second wall. The restricting member includes a first hook and a second hook. The first hook extends from one end of the first sidewall. The second hook extends from one end of the second sidewall. An end of the first hook and an end of the second hook are spaced from each other. When the electrical terminal is received in the receiving space, the first hook engages with the second hook, to prevent the receiving space from being stretch beyond a predetermined size or size range.

4 Claims, 3 Drawing Sheets

ELECTRICAL RECEPTACLE TERMINAL

BACKGROUND

1. Technical Field

The present disclosure relates to electrical receptacles, especially to a electrical receptacle terminal.

2. Description of Related Art

Electrical receptacles/outlets include terminals for receiving terminals of an inserted plug. Over time and with repeated use, the terminals may lose their ability to firmly hold the terminals of the plug due to permanent deformation.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
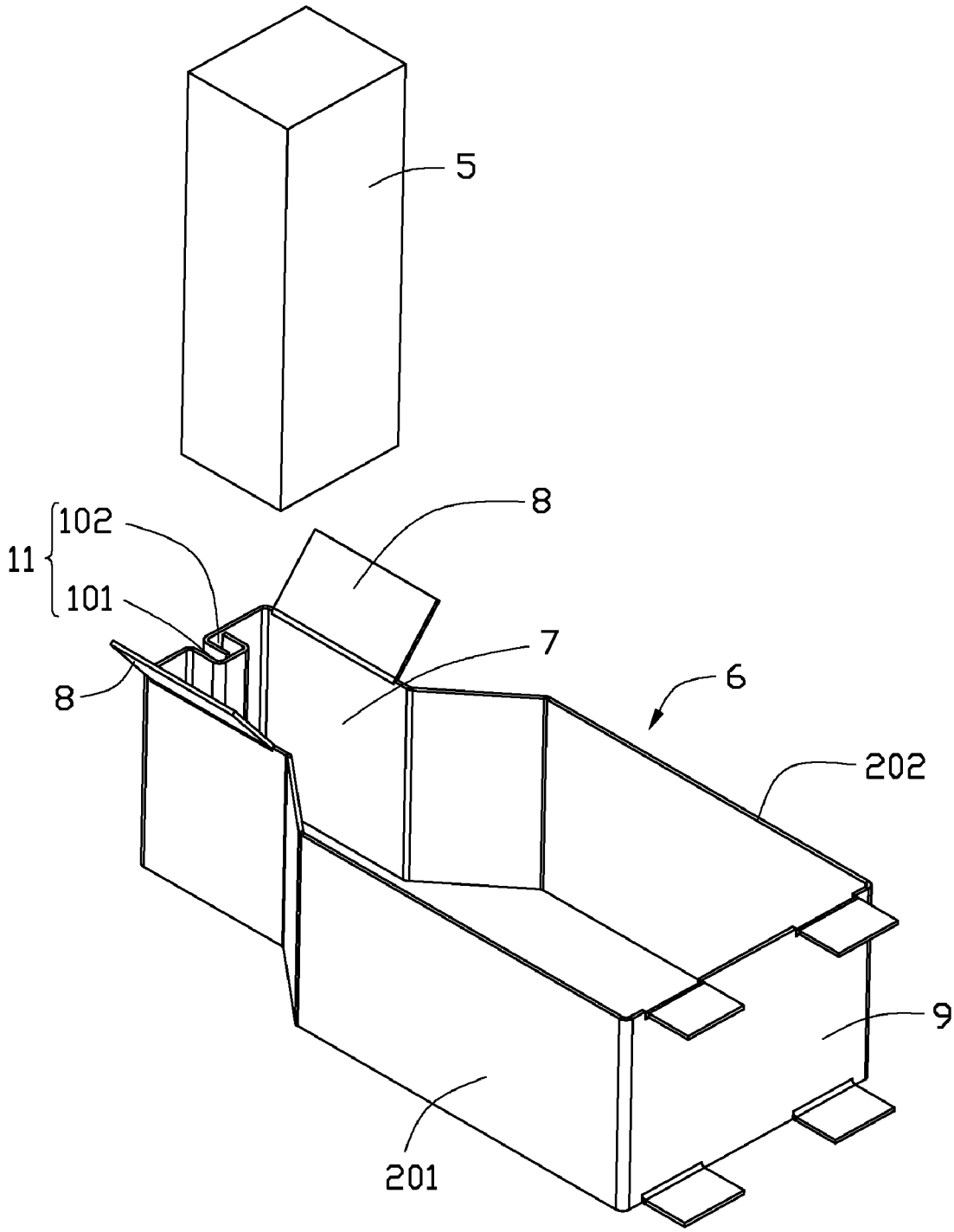
FIG. 1 is an isometric view of an electrical receptacle terminal according to an exemplary embodiment, and a plug.
Figure 2:
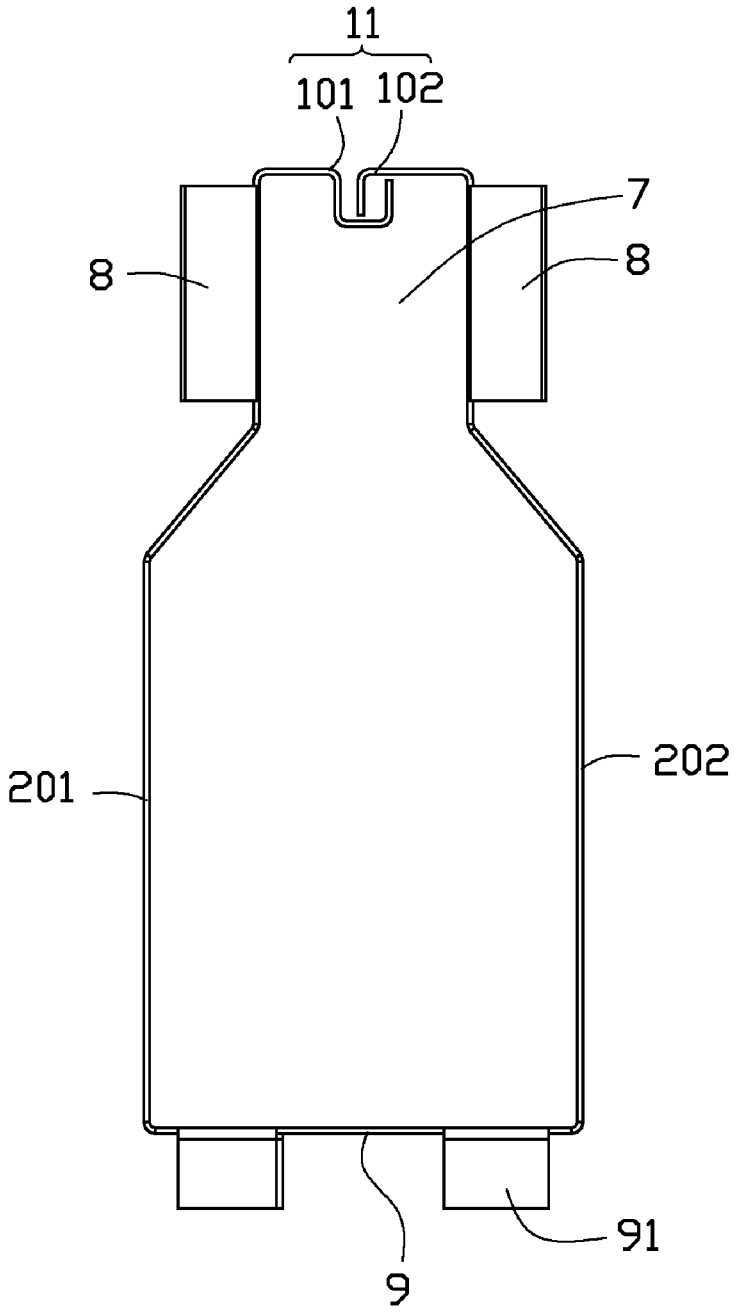
FIG. 2 is a front elevational view of electrical receptacle terminal in FIG. 1.

Referring to FIGS. 1 and 2, a receptacle terminal 6, utilized in an electrical receptacle (not shown) for receiving an electrical terminal, includes a first sidewall 201, a second sidewall 202, a connecting member 9 and a restricting member 11.

The first sidewall 201 and the second sidewall 202 are substantially parallel to each other. The sidewalls 201 and 202 can be made of sheet metal. A receiving space 7 is formed between ends of the first sidewall 201 and the second sidewall 202. The receiving space 7 is used to receive an electrical terminal 5 of a plug. When the electrical terminal 5 is inserted into the receiving space 7, the first sidewall 201 and the second sidewall 202 are urged to move outwardly, which generates a spring force to firmly hold the electrical terminal 5 in place. A pair of inclined guiding pads 8 respectively extends upwardly from the tops of the first sidewall 201 and the second sidewall 202. The guiding pads 8 are used for guiding the electrical terminal 5 into the receiving space 7.

The connecting member 9 is fixed between the first sidewall 201 and the second sidewall 202. In the embodiment, the connecting member 9 and the sidewalls 201 and 202 can be integrally formed. The connecting member 9 includes four protruding portions 91 to fix the receptacle terminal 6 to the electrical receptacle.

The restricting member 11 includes a first hook 101 and a second hook 102. The first hook 101 extends from one end of the first sidewall 201. The second hook 102 extends from one end of the second sidewall 202, facing the first hook 9. The ends of the first hook 101 and the second hook 102 are engaged with each other. A predetermined distance is defined between the ends of the second hook 102 and the first hook 101.

Figure 3:
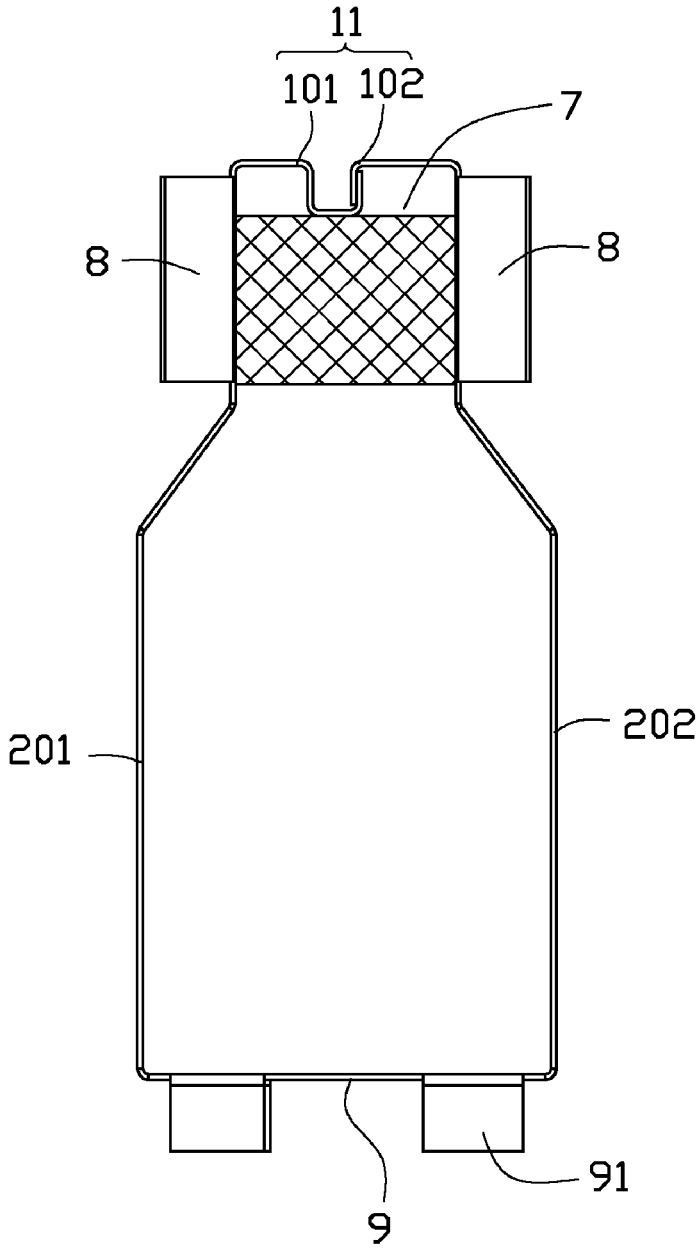
FIG. 3 is similar to FIG. 2, illustrating the electrical receptacle terminal of FIG. 1 with the plug inserted therein.

Referring to FIG. 3, when the electrical terminal 5 is inserted into the receiving space 7, the first sidewall 201 and the second sidewall 202 are urged to move outwardly and cooperatively hold the electrical terminal 5 firmly in place. The end of the first hook 101 then engages with the second hook 102, which ensures that the width of the receiving space 7 stays a predetermined size or size range. In this way, the electrical terminal 5 can always make a transitional fit in the receiving space 7. As a result, even after long time and repeated use, the receptacle terminal 6 can still firmly hold the electrical terminal 5.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A receptacle terminal to be utilized in an electrical receptacle, comprising:

a first sidewall;

a second sidewall cooperating with the first sidewall to define a receiving space to receive an electrical terminal;

a connecting member to connect the first sidewall to the second wall; and a restricting member comprising a first hook and a second hook, the first hook extending from one end of the first sidewall, the second hook extending from one end of the second sidewall, an end of the first hook and an end of the second hook being spaced from each other;

wherein when the electrical terminal is received in the receiving space, the first hook engages with the second hook, to prevent the receiving space from being stretch beyond a predetermined size or size range.

2. The receptacle terminal of claim 1, further comprises a pair of inclined guiding pads respectively extending upwardly from tops of the first sidewall and the second sidewall, the pair of the guiding pads are configured for guiding the electrical terminal to be inserted into the receiving space.

3. The receptacle terminal of claim 1, wherein the connecting member comprises four protruding portions to fix the receptacle terminal to the electrical receptacle.

4. The receptacle terminal of claim 1, wherein the connecting member, the first sidewall and the second sidewall are integrally formed.

* * * * *